US006659599B2

(12) United States Patent
Putman et al.

(10) Patent No.: US 6,659,599 B2
(45) Date of Patent: Dec. 9, 2003

(54) MAXIMUM LIQUID LEVEL IN DUAL CHAMBER INK-JET CARTRIDGE TO CONTROL HEAD PRESSURE EFFECT ON INK CONTAINING POROUS MEMBER IN AN INK-JET PRINTER

(75) Inventors: William A. Putman, Franklin, TN (US); Stephen A. Anderson, Thompson Station, TN (US)

(73) Assignee: Seiko Epson Corporation, Nagano-ken (JP)

( * ) Notice: Subject to any disclaimer, the term of this patent is extended or adjusted under 35 U.S.C. 154(b) by 0 days.

(21) Appl. No.: 10/148,986

(22) PCT Filed: Oct. 5, 2001

(86) PCT No.: PCT/US01/31281

§ 371 (c)(1),
(2), (4) Date: Jun. 4, 2002

(87) PCT Pub. No.: WO02/28651

PCT Pub. Date: Apr. 11, 2002

(65) Prior Publication Data

US 2003/0001935 A1 Jan. 2, 2003

Related U.S. Application Data

(60) Provisional application No. 60/239,073, filed on Oct. 6, 2000.

(51) Int. Cl.[7] ..... B41J 2/175
(52) U.S. Cl. ..... 347/86
(58) Field of Search ..... 347/85, 86, 87, 347/92, 93

(56) References Cited

U.S. PATENT DOCUMENTS 5,875,615 A * 3/1999 Ito et al. ..... 53/474
6,238,042 B1 * 5/2001 Kobayashi et al. ..... 347/86
6,325,499 B1 * 12/2001 Betschon ..... 347/86

* cited by examiner

*Primary Examiner*—Anh T. N. Vo
(74) *Attorney, Agent, or Firm*—Squire, Sanders & Dempsey L.L.P.

(57) ABSTRACT

An ink tank cartridge has a housing with a bottom wall and first and a divider that separates a housing cavity into second chambers. An ink supply port with an opening extends through and projects from the bottom wall. A porous member is accommodated in one of the chambers and abuts the opening in the ink supply port. The other chamber is partially filled with ink to a pre-determined level. The predetermined level is approximately 2 millimeters above the opening in the bottom wall in a preferred arrangement. The predetermined level is used to prevent excessive flow of ink through the opening in the bottom wall. A groove is formed in the bottom wall to direct and transfer ink from the porous member to the ink supply port.

16 Claims, 3 Drawing Sheets

MAXIMUM LIQUID LEVEL IN DUAL CHAMBER INK-JET CARTRIDGE TO CONTROL HEAD PRESSURE EFFECT ON INK CONTAINING POROUS MEMBER IN AN INK-JET PRINTER

CROSS-REFERENCE TO RELATED APPLICATIONS

This application claims priority from Provisional Application No. 60/239,073 filed on Oct. 6, 2000.

BACKGROUND OF THE INVENTION

This invention relates generally to the ink-jet printing art for ejecting ink droplets on the recording medium, such as paper and more particularly, to an ink tank cartridge for use in an ink-jet type recording apparatus such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. Controlling the flow of ink from the cartridge is a concern. When ink is supplied from an ink tank, ink in the tank located in a region remote from the supply port flows toward the supply port as a result of a pressure difference. Capillary action of the ink impregnated member or foam in the vicinity of the supply port is increased due to ink consumption.

A cartridge can be divided into multiple chambers, where a porous foam or material is positioned over an outlet port in one chamber and free ink is filled into the other chamber. The free ink migrates from its chamber into the foam through an opening between the two chambers. The foam, in turn, controls the flow of ink that enters an ink outlet port.

If the ink level in the free-ink chamber becomes too high, then the back pressure of ink results in an undesirable excessive flow of ink through the outlet port.

Accordingly, it is desirable to develop a new and improved ink cartridge that meets the above stated needs and others and provides better, more advantageous overall results.

SUMMARY OF THE INVENTION

Generally speaking, in accordance with the invention, an ink tank cartridge for an ink-jet type recording apparatus is removably mounted on an ink supply needle of a recording body.

More particularly, the invention relates to an ink tank cartridge having a housing with a divider wall used to separate the housing into first and second chambers. The divider wall has an opening which allows ink to pass between the first and second chambers. An ink supply port with an opening extends through a bottom wall of the housing. A porous member is accommodated in one of the chambers and abuts the opening in the ink supply port. The other chamber is partially filled with ink to a predetermined level. The predetermined level is approximately 2 millimeters above the opening in the bottom wall. This level is used to establish a desired pressure head that prevents excessive flow of ink through the opening in the bottom wall.

A groove is formed in the bottom wall to direct and transfer ink from the porous member to the ink supply port. A filter is positioned between ink supply port and the porous member. The filter is preferably sealed over the grooves in the ink supply port. The porous member has pores of larger size than the pores in the filter.

Still other aspects of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE EMBODIMENTS

Figure 1:
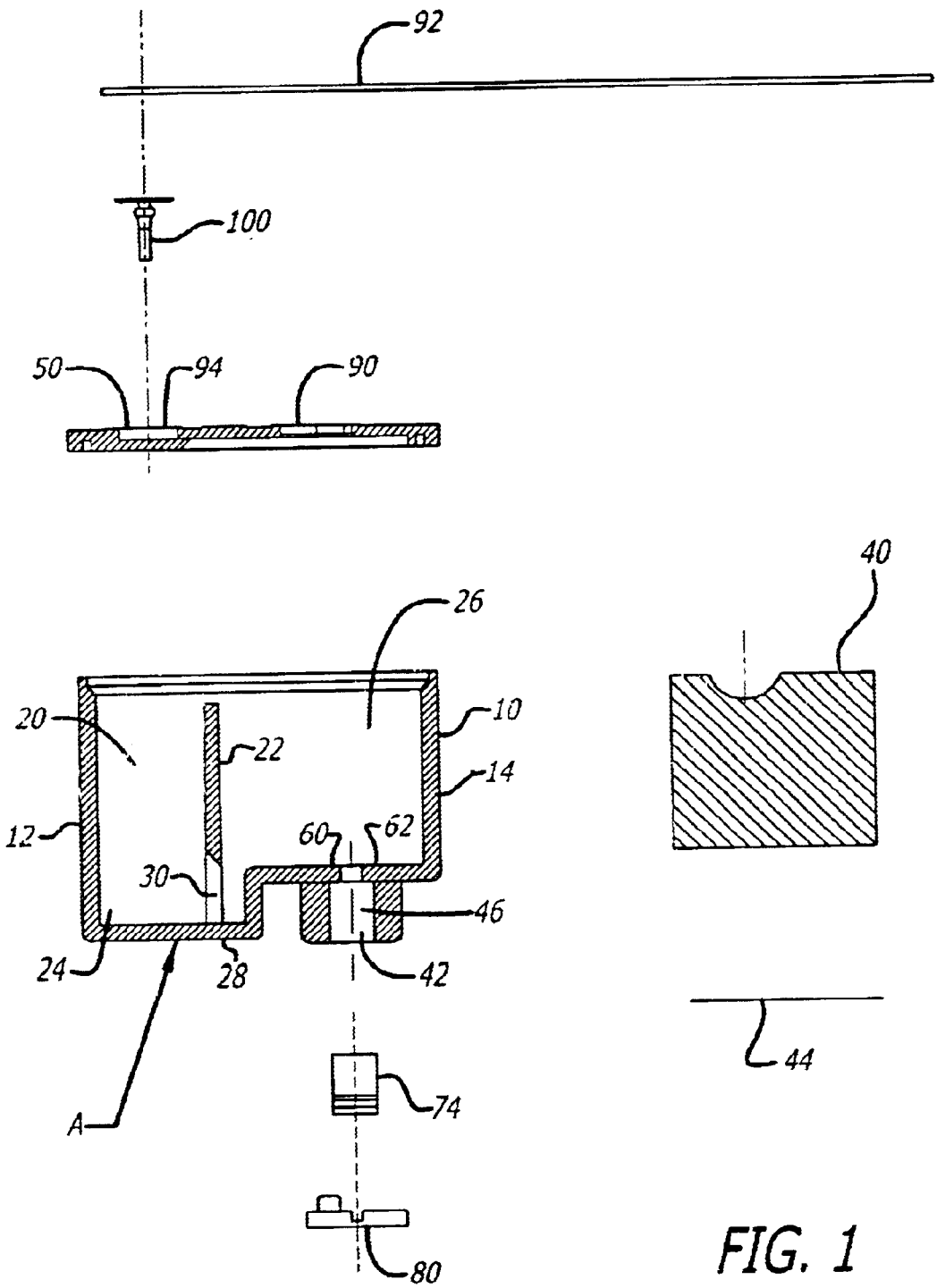
FIG. 1 is an exploded elevational view of an ink cartridge according to a first embodiment of the present invention.

Referring now to the drawings, wherein the showings are for purposes of illustrating preferred embodiments of the invention only and not for purposes of limiting same, FIG. 1 shows an ink tank cartridge A according to one embodiment of the present invention.

More specifically, the ink tank cartridge comprises a case or housing 10 which has an internal cavity of a generally rectangular cross section. The housing has a series of walls 12, 14, 16, 18 which form internal cavity 20. An additional wall or spacer 22 divides the housing internal cavity into two substantially equally sized chambers 24, 26. The wall 22 extends laterally between opposed sides of the housing and extends upwardly from a bottom wall 28 to an open top end of the housing effectively dividing the internal cavity into first and second chambers. An opening or recess 30 extends from a bottom of the wall 22 adjacent the bottom wall 28 placing the chambers into communication with each other for ink storage and transfer purposes. Chamber 24 is used to store free ink while chamber 26 receives an ink absorbing or porous member 40.

The ink absorbing member is a block of porous material or foam and is preferably formed of Melamine™ or hydrophilic foam. The absorbing member is disposed in chamber 26 adjacent an outlet port 42 within the housing bottom wall. The porous member 40 is constructed with a cross-sectional area slightly greater than the cross-sectional area of the chamber of the housing. A filter or screen 44 is inserted over the outlet port. The screen is interposed between the ink absorbing member and the outlet port to prevent egress of air bubbles, contaminants, and the like from the cartridge from entering the associated printer (not shown). Filter 44 comprises mesh, such as a woven material, having a pore size of about 0.5–100 microns, and preferably 0.5–30 microns, which is less than the pore sizes in the ink absorbing member. The outlet port 42 includes an opening 46 and a pipe-like member or chimney 48 which extends from the bottom wall of the housing. Opening 46 is in communication with an opening 49 in the bottom wall.

Figure 2:
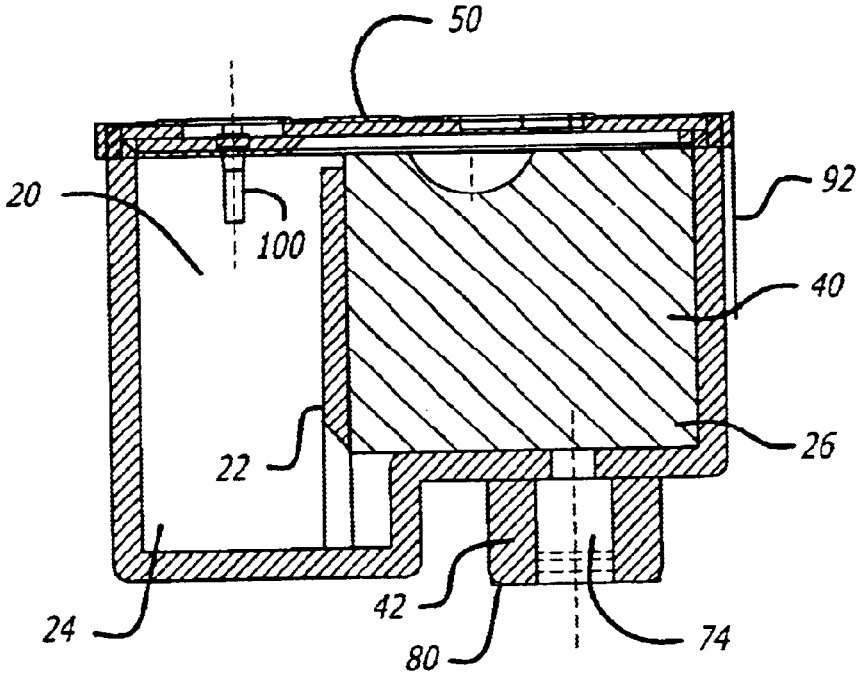
FIG. 2 is a side elevational view in cross-section of the ink cartridge of FIG. 1 in an assembled configuration.

Referring to FIG. 2, after the filter and ink absorbing member have been installed and properly positioned in the first chamber, a cover 50 is fixedly secured to the housing by ultrasonic welding. The height of the ink absorbing member is slightly less than the inside height of the housing as measured between the bottom wall and the underside of the cover. Thus, there is no compression of the ink absorbing member in the vertical direction.

Figure 3:
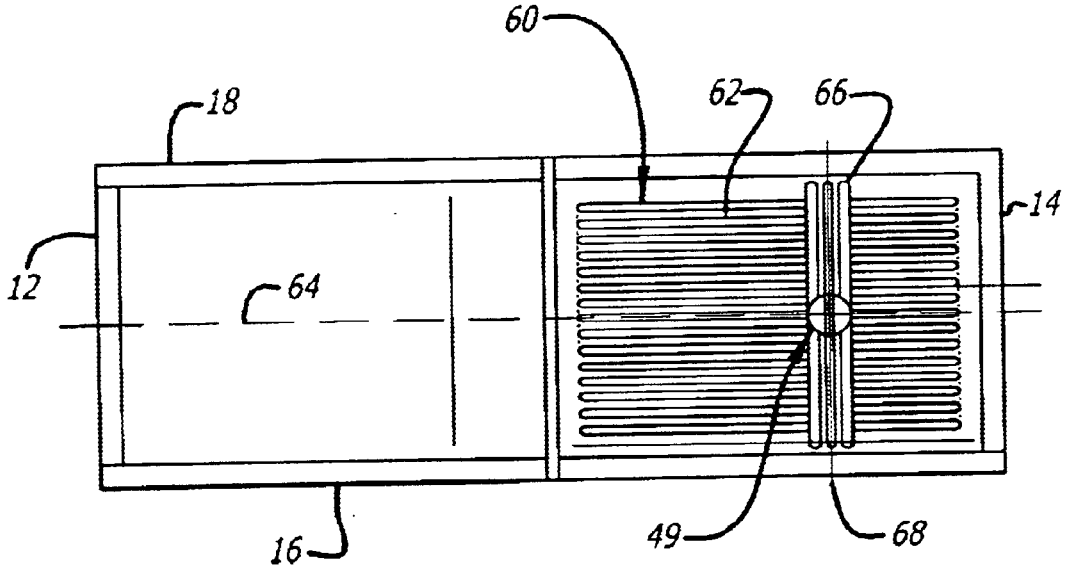
FIG. 3 is a top plan view of the interior of the ink cartridge of FIG. 1; and, FIG. 4 is a side elevational view in cross-section showing the ink level within the ink cartridge.

The filter is preferably fuse bonded adjacent the inner opening of the ink supply port and extends over a recessed geometric pattern 60 (see FIG. 3) located within the bottom wall of the cartridge. As seen in FIG. 3, the geometric pattern forms a series of equally spaced, generally parallel grooves 62 which extend radially along a longitudinal axis 64 of the outlet port and are used to transfer ink to the outlet port. A second set of parallel grooves 66 are positioned on a transverse axis 68 of the cartridge on opposite sides of the ink outlet port. These grooves are wider than the grooves 62 to serve as a sink or drain for transferring ink to the cartridge. It should be noted that other groove configurations may be used.

A silicone seal member or grommet 74 is inserted into the chimney 48 through opening 46. Each grommet is somewhat cup-shaped and has an open end facing toward the interior of the cartridge. A web of material is disposed closely adjacent the other, or outer, end which closes the grommet. The closed end of the grommet is pierced by a needle extending from an associated printer (not shown) to create an ink supply only when and as the cartridge is mounted in a printer. A grommet retaining ring 80 placed onto the outer end of the chimney over each grommet is ultrasonically welded into place. The grommet retaining ring has an enlarged central opening (not shown) to provide access to the grommet and outlet port. Also, the retaining ring includes slots that align with and receive terminal ends of extending ribs on the chimney.

As illustrated in FIG. 1, the cover has a fill hole 90 and a recessed, vent passage 94, and is attached to the cartridge housing forming a fluid-tight seal therewith. Retained in the vent passage is a seal for selectively permitting the passage of fluid between the interior and the exterior of the cartridge. The seal is in the form of a check valve 100. However, it will be appreciated that the seal may take the form of any suitable sealing member, including a septum seal plug. The check valve 100 forms a one-way fluid passage between the interior and the exterior of the cartridge, permitting fluid to pass from the interior of the cartridge while preventing any substantial flow of fluid from the exterior to the interior of the cartridge.

The assembled cartridge is inserted in a fixture and the region around the fill hole is sealed so that a negative pressure (a pre-fill vacuum of 27.5 in Hg within the cartridge) is applied to the cartridge through the fill hole to remove air from the open cells within the porous member.

The cartridge is subsequently filled with ink through the fill hole of the cover using degassed ink. Either black ink or different color inks, i.e. cyan, magenta, and yellow ink, may be introduced into the chamber(s) of the cartridge. The ink is introduced under pressure into the cartridge to maximize the amount of ink for consumer end use and minimize the likelihood of air bubble entrapment.

After the cartridge has been evacuated and pressure filled, the cartridge is again evacuated through the filling port to degas the ink which may have retained air during the filling operation. The filling port is then sealed, such as by seal film 92, and a negative pressure is applied to the cartridge through the check valve which opens in response to the negative pressure causing the generation of a negative pressure within the cartridge. Once the vacuum pressure is discontinued, the one-way check valve closes retaining the negative pressure within the cartridge. Subsequently, the remainder of the cartridge cover is sealed with a laminate seal thermally attached to the remaining portion of the cover over the diaphragm valve to seal air from the cartridge until the seal is removed by the consumer when the cartridge is installed on the printer. It will be appreciated that the fill hole is utilized as a vent hole after the foil seal is removed by the consumer.

Figure 4:
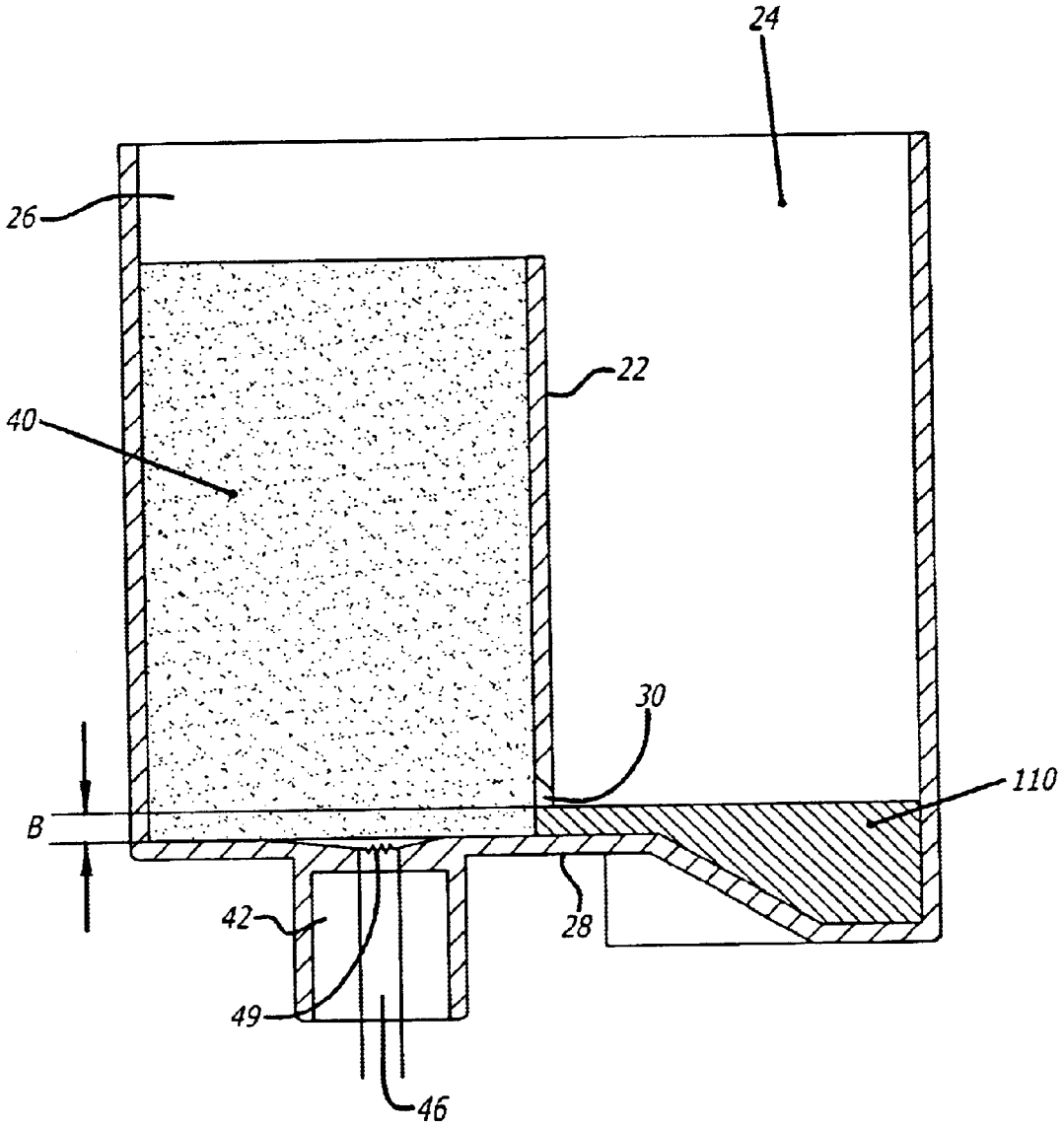

Referring now to FIG. 4, as previously discussed the cartridge is filled with ink 110 under pressure. At least some of the ink enters chamber 24 which is the free-ink side of the cartridge. The fluid level of the ink must not exceed a pre-determined value, above the top of the opening 49 in the bottom wall 28 of the cartridge. This pre-determined fluid level may vary from one type/line of ink cartridges to another. For example, factors that may affect the pre-determined level include the internal pressure in the ink cartridge, the type of porous member, the average pore size of the porous member, the pore size of the filter, the size of the outlet opening, etc. In FIG. 4, the level of ink above the opening is designated as "B". If the level of ink "B" exceeds the pre-determined value, e.g., 2 millimeters, in a preferred embodiment, a head pressure builds due to the volume of ink in the free ink chamber which cannot be accommodated by the ink absorbing member. That is, the ink absorbing member cannot exert sufficient back pressure to accommodate the increased pressure head and, therefore, ink has a tendency to leak or drip from the outlet port at an unacceptable rate. A height of two millimeters has been determined to be an acceptable level for the ink in the free ink chamber to prevent this from occurring in a preferred arrangement. It will be appreciated, however, that other levels are deemed to fall within the scope of the present invention.

The invention has been described with reference to several preferred embodiments. Obviously, alterations and modifications will occur to others upon a reading and understanding of this specification. For example, although the drawings and above description refer to a single cavity 20 divided into first and second generally equal-sized chambers for a single ink, the teachings of the present invention apply to chambers of unequal size, and multiple cavities/chambers that accommodate multiple inks. Moreover, the fluid level height may vary from one cavity/chamber to another in a multiple ink cartridge assembly. The invention is intended to include all such modifications and alterations insofar as they come within the scope of the appended claims or the equivalents thereof.

Having thus described the preferred embodiments, the invention is now claimed to be:

1. An ink tank cartridge for an ink-jet type recording apparatus, comprising:

a housing having a bottom wall, and first and second chambers an ink supply port extending through and projecting from said bottom wall, said port having an opening;

a porous member accommodated in one of said first and second chambers, said porous member abutting said opening of said supply port; and wherein the other of said first and second chambers is partially filled with ink to a predetermined level approximately 2 millimeters above an opening in said bottom wall said predetermined level of ink prevents excessive flow of ink through said opening of said bottom wall.

2. An ink tank cartridge for an ink-jet type recording apparatus, the ink tank cartridge comprising:

a housing having a bottom wall, and first and second chambers said first and second chambers being in fluid communication through openings at the bottom and the top of the chambers; said first and second chambers being in fluid communication through openings at the bottom and the top of the chambers;

an ink supply port extending through and projecting from said bottom wall, said port having an opening;

a porous member accommodated in one of said first and second chambers, said porous member abutting said opening of said supply port; and, wherein the other of said first and second chambers is partially filled with ink to a predetermined level.

3. The ink tank cartridge of claim 2, wherein said predetermined level is approximately 2 millimeters above an opening in said bottom wall.

4. The ink tank cartridge of claim 2, wherein said porous member comprises porous hydrophilic foam.

5. The ink tank cartridge of claim 2, further comprising a divider wall positioned within said housing to divide said housing into said first and second chambers.

6. The ink tank cartridge of claim 2, further comprising a groove formed in said bottom wall to direct and transfer ink from said porous member to said ink supply port.

7. The ink tank cartridge of claim 2, further comprising a filter positioned between said ink supply port and said porous member.

8. The ink tank cartridge of claim 2, wherein said porous member has pores of larger size than pores in said filter.

9. The ink tank cartridge of claim 2, wherein said divider wall comprises an opening allowing ink to pass between said first and second chambers.

10. The ink tank cartridge of claim 2, wherein said filter is sealed over grooves in said bottom wall which extend to said ink supply port.

11. The ink tank cartridge of claim 2, further comprising a cover which is sealed to said housing.

12. The ink tank cartridge of claim 11, wherein said cover comprises at least one vent hole and at least one fill hole.

13. The ink tank cartridge of claim 2, further comprising a plug which is inserted into said fill hole to maintain negative pressure in said cartridge.

14. An ink tank cartridge for an ink-jet type recording apparatus, the ink tank cartridge comprising:

a housing having a bottom wall and a plurality of side walls forming a cavity;

a divider wall positioned within said cavity to divide said cavity into a first chamber and a second chamber said divider wall having an opening near the bottom wall and at the top of the chambers to allow fluid communication between said first and second chambers;

an ink supply port extending through and projecting from said bottom wall, said ink supply port having an opening;

a porous member accommodated in one of said first and second chambers, said porous member resiliently abuts said opening of said supply port;

a groove formed in said bottom wall to direct and transfer ink from said porous member to said ink supply port;

a filter positioned between said porous member and said ink supply port and positioned over said groove; and, wherein the other of said first and second chambers is partially filled with ink to a predetermined level.

15. The ink tank cartridge of claim 14, wherein said predetermined level is approximately 2 millimeters above an opening in said bottom wall.

16. An ink tank cartridge, for an ink-jet type recording apparatus, the ink tank cartridge comprising:

a housing having a bottom wall and a plurality of side walls forming a cavity;

a divider wall positioned within said cavity to divide said cavity into a first chamber and a second chamber said divider wall having an opening near the bottom wall and at the top of the chambers to allow fluid communication between said first and second chambers;

an ink supply port extending through and projecting from said bottom wall, said ink supply port having an opening;

a porous member accommodated in one of said first and second chambers, said porous member resiliently abuts said opening of said supply port;

a groove formed in said bottom wall to direct and transfer ink from said porous member to said ink supply port;

a filter positioned between said porous member and said ink supply port and positioned over said groove; and wherein the other of said first and second chambers is partially filled with ink to a predetermined level approximately 2 millimeters above an opening in said bottom wall said predetermined level of ink prevents excessive flow of ink through said opening of said bottom wall.

* * * * *